US009346525B2

(12) United States Patent
Scapin

(10) Patent No.: US 9,346,525 B2
(45) Date of Patent: May 24, 2016

(54) SHIP DRIVE

(71) Applicant: ZF Friedrichshafen AG, Friedrichshafen (DE)

(72) Inventor: Angelo Scapin, Marghera (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 14/386,025

(22) PCT Filed: Mar. 12, 2013

(86) PCT No.: PCT/EP2013/054939
§ 371 (c)(1),
(2) Date: Sep. 18, 2014

(87) PCT Pub. No.: WO2013/159983
PCT Pub. Date: Oct. 31, 2013

(65) Prior Publication Data

US 2015/0050153 A1 Feb. 19, 2015

(30) Foreign Application Priority Data

Apr. 23, 2012 (DE) ..... 10 2012 206 645

(51) Int. Cl.
*B63H 5/125* (2006.01)
*B63H 1/04* (2006.01)
(Continued)

(52) U.S. Cl.
CPC .. *B63H 1/04* (2013.01); *B63H 5/07* (2013.01); *B63H 5/125* (2013.01); *B63H 21/30* (2013.01); *B63H 21/305* (2013.01); *B63H 23/34* (2013.01); *B63H 2023/342* (2013.01)

(58) Field of Classification Search
CPC ..... B63H 5/125; B63H 21/30; B63H 23/00; B63H 23/36; B63H 1/04; B63H 23/34; B63H 5/07; B63H 2023/342
USPC ..... 440/75, 111, 112; 416/205
See application file for complete search history.

(56) References Cited

U.S. PATENT DOCUMENTS 2,722,848 A 11/1955 Stein
3,327,555 A 6/1967 Cleff
(Continued)

FOREIGN PATENT DOCUMENTS

DE 1 713 489 U 12/1955
DE 1 231 489 12/1966
(Continued)

OTHER PUBLICATIONS

German Search Report Corresponding to 10 2012 206 645.4 mailed Feb. 25, 2014.
(Continued)

*Primary Examiner* — Lars A Olson
(74) *Attorney, Agent, or Firm* — Davis & Bujold PLLC; Michael J. Bujold

(57) ABSTRACT

A ship drive having a drive machine, a transmission, a propeller shaft that is driven by the transmission and a mounting arrangement by which the ship drive can be secured to a hull of a ship. The drive machine and the transmission are connected to one another by a connecting flange and are arranged inside the hull of the ship. A first mounting point, which is designed as a pivot bearing relative to the rotational axis of the propeller shaft, is arranged in such a manner that a bending moment, produced by the propeller thrust and by the weight of the drive machine and the transmission, is optimized at the connecting flange.

11 Claims, 2 Drawing Sheets

(51) Int. Cl.

| | |
|---|---|
| ***B63H 21/30*** | (2006.01) |
| ***B63H 5/07*** | (2006.01) |
| ***B63H 23/34*** | (2006.01) |

(56) References Cited

U.S. PATENT DOCUMENTS

| | | | |
|---|---|---|---|
| 3,918,387 | A | 11/1975 | Jobst |
| 5,478,264 | A | 12/1995 | Law |
| 5,797,778 | A | 8/1998 | Ito et al. |
| 5,944,569 | A | 8/1999 | Buzzi |
| 6,540,572 | B2 | 4/2003 | Buzzi |

FOREIGN PATENT DOCUMENTS

| | | | |
|---|---|---|---|
| DE | 23 30 832 | A1 | 1/1975 |
| DE | 199 54 691 | A1 | 5/2001 |
| DE | 695 26 245 | T2 | 11/2002 |
| DE | 20 2006 010 783 | U1 | 11/2006 |
| EP | 0 792 234 | B1 | 4/2002 |
| EP | 1 526 052 | A1 | 4/2005 |
| FR | 1 257 775 | | 2/1961 |

OTHER PUBLICATIONS

International Search Report Corresponding to PCT/EP2013/054939 mailed Jun. 7, 2013.

Written Opinion Corresponding to PCT/EP2013/054939 mailed Jun. 7, 2013.

SHIP DRIVE

This application is a National Stage completion of PCT/EP2013/054939 filed Mar. 12, 2013, which claims priority from German patent application serial no. 10 2012 206 645.4 filed Apr. 23, 2012.

FIELD OF THE INVENTION

The present invention concerns a ship drive having a drive machine, a transmission, a propeller shaft driven by the transmission and a mounting arrangement by means of which the ship drive can be secured to the hull of a ship, wherein the drive machine and the transmission are connected to one another by a connecting flange and are arranged inside the hull of the ship.

BACKGROUND OF THE INVENTION

Ship drives with a drive machine, a transmission, a propeller shaft and a mounting arrangement for securing the drive components in the hull of the ship, such that the drive machine and the transmission are arranged inside the ship's hull, are known. A satisfactory mounting arrangement for such a ship drive in the ship's hull has to fulfill a number of requirements. Firstly, the mounting arrangement has to absorb and transfer to the hull of the ship both the weight of the drive aggregate consisting of the drive machine and the transmission, and also the thrust force produced by the propeller during operation.

Secondly, the torques produced by the drive machine and the propeller shaft during operation have to be supported. For example, in the ship drive described above the connecting flange between the drive machine and the transmission is particularly highly loaded by bending torques, which are caused by the propeller thrust force, or propeller thrust for short, and the weight of the drive machine and the transmission.

Thirdly, the mounting arrangement has to absorb vibrations excited in particular by a drive machine, for example an internal combustion engine that is running. Such vibrations should be prevented from being transmitted to the ship's hull and so giving rise to troublesome noise or vibration damage to the ship's hull.

A mounting arrangement for a ship drive designed to achieve those aims is known for example from EP 0792234 B1. That document describes a so-termed three-point mounting system as the mounting arrangement, in which a ship motor and a ship drive are mounted in an elaborate arrangement in the hull of a ship.

SUMMARY OF THE INVENTION

The purpose of the present invention is to further improve a ship drive, in which the drive machine and the transmission are arranged inside the hull of the ship, in relation to fatigue strength and to simplicity, low production cost and ease of assembly, such that the ship drive and its mounting arrangement fulfill the requirements mentioned earlier.

The objective of the invention is achieved by a ship drive having the characteristics as described below.

According to these a ship drive is claimed, which comprises a drive machine, a transmission, a propeller shaft driven by the transmission, and a mounting arrangement with which the ship drive can be secured in a hull of a ship, the drive machine and the transmission being connected with one another by means of a connecting flange and being arranged inside the ship's hull. According to the invention, a first mounting point in the form of a bearing that pivots relative to the propeller shaft is arranged in such manner that bending torque caused by the propeller thrust and by the weight of the drive machine and the transmission, is optimized.

It has been found advantageous for at least one of a plurality of mounting points of the mounting arrangement to be made in the form of a pivot bearing. The ability of the drive aggregate to pivot about the pivot axis of the pivot bearing, which results from that, enables distortions of the drive aggregate that occur during its operation to be compensated.

The bending torque at the connecting flange is preferably optimized by locating the rotational axis of the propeller shaft within a narrow zone around the pivot axis of the pivot bearing, such that the rotational axis extends past the pivot axis of the pivot bearing at a distance of less than 500 mm. Within that zone the distance between the rotational axis and the pivot axis can be varied depending on the desired torque development. Preferably, for example, distances in the range between 1 and 100 mm can be chosen.

The claimed position of the rotational axis of the propeller shaft, past but close to the pivot axis of the pivot bearing, prevents the thrust force of the propeller shaft from producing a high torque about the pivot axis of the pivot bearing at the first mounting point. In this way the bending moment produced due to the thrust force of the propeller shaft at the connecting flange between the drive machine and the transmission is kept small. At the same time, however, the desired ability of the drive aggregates to pivot about the pivot axis in order to compensate for distortions during operation is ensured.

The connecting flange and its connecting elements, for example screw-bolts, consequently have to withstand substantially lower loads and can therefore be made smaller and lighter. Lower component loads also result in longer component life. The drive machine and its housing, too, are not loaded by torque caused by the propeller thrust, or only very slightly so. Instead, for example by way of a thrust bearing, the propeller thrust is transmitted via the transmission housing and the first mounting point to the hull of the ship.

In a preferred design of the invention the rotational axis of the propeller shaft passes above the pivot axis. Depending on the distance between the rotational axis and the pivot axis, the propeller thrust then produces torque that opposes the bending moment caused at the connecting flange by the weight of the drive machine and the transmission. In this way the maximum occurring bending moment at the connecting flange during operation of the ship drive can be reduced and the fatigue strength of the ship drive improved.

The term 'above' used in this document refers to the condition of the ship drive fitted according to specification in a ship that is upright in calm water. The terms 'horizontal' and 'vertical' used herein are understood to mean that horizontal is parallel to the calm surface of the water and vertical is perpendicular thereto.

In another preferred design of the invention, the rotational axis of the propeller shaft intersects the pivot axis of the pivot bearing. This embodiment of the invention completely prevents the thrust force of the propeller shaft from producing any torque at all about the pivot axis of the pivot bearing of the first mounting point. Thus, at the connecting flange between the drive machine and the transmission there is no additional torque due to the thrust force of the propeller shaft. At the same time, however, the ability of the drive aggregate to pivot about the pivot axis of the pivot bearing in order to compensate vibrations and distortions during operation, is ensured. Preferably, the pivot axis of the pivot bearing extends in the horizontal direction and for example transversely to the travel direction of the ship. In other words, the substantially horizontal pivot axis of the pivot bearing is understood to mean that by definition the pivot axis, when the ship is in or moving in the water, is parallel to the water's surface.

Advantageously, with the present invention the dimensions of further mounting points can be made smaller and lighter, because the propeller thrust force is absorbed by the first mounting point or transferred by it to the hull of the ship. Preferably, to enable this, the first mounting point is secured firmly to longitudinal support members of the ship's hull by a holding fixture. For example, the holding fixture can be attached firmly to so-termed stringers that extend in the longitudinal direction of the ship's hull and are solidly connected thereto or made integrally with it.

The pivot bearing takes up deformations of the drive aggregate formed by the drive machine and the transmission, which are produced for example by vibrations and thermal expansion during operation. For this, in a further preferred design of the invention the first mounting point comprises at least one vibration-absorbing element. For that purpose, elements made for example of an elastic material and/or spring elements are suitable.

A simple and stable structure of the ship drive is obtained if parts of the first mounting point are made integrally with the housing of the transmission.

Preferably, the mounting arrangement is a so-termed three-point mounting system and accordingly has exactly three mounting points, the second and third mounting points being arranged on the drive machine. The second and third mounting points can be made at least partially integrally with a housing of the drive machine. As with the first mounting point, so too the second and third ones can also comprise vibration-absorbing elements in order to damp troublesome vibrations generated in particular by the drive machine, so that they are not transmitted to the hull of the ship. An internal combustion engine is often used as the drive machine of a ship. An internal combustion engine generates troublesome vibrations in the ship, which depend for example on the number and size of the internal combustion engine's cylinders and which contribute to noise emission. By virtue of vibration-absorbing elements the noise emission is affected favorably and troublesome vibrations are reduced close to their source. Both these actions improve passenger comfort and reduce the loading of other components of the ship.

Finally, the present invention includes a ship with a ship drive as described above.

BRIEF DESCRIPTION OF THE DRAWINGS

The invention will be described in greater detail with reference to the embodiment described below and illustrated in the figures, which show.

DETAILED DESCRIPTION OF THE PREFERRED EMBODIMENTS

Figure 1:
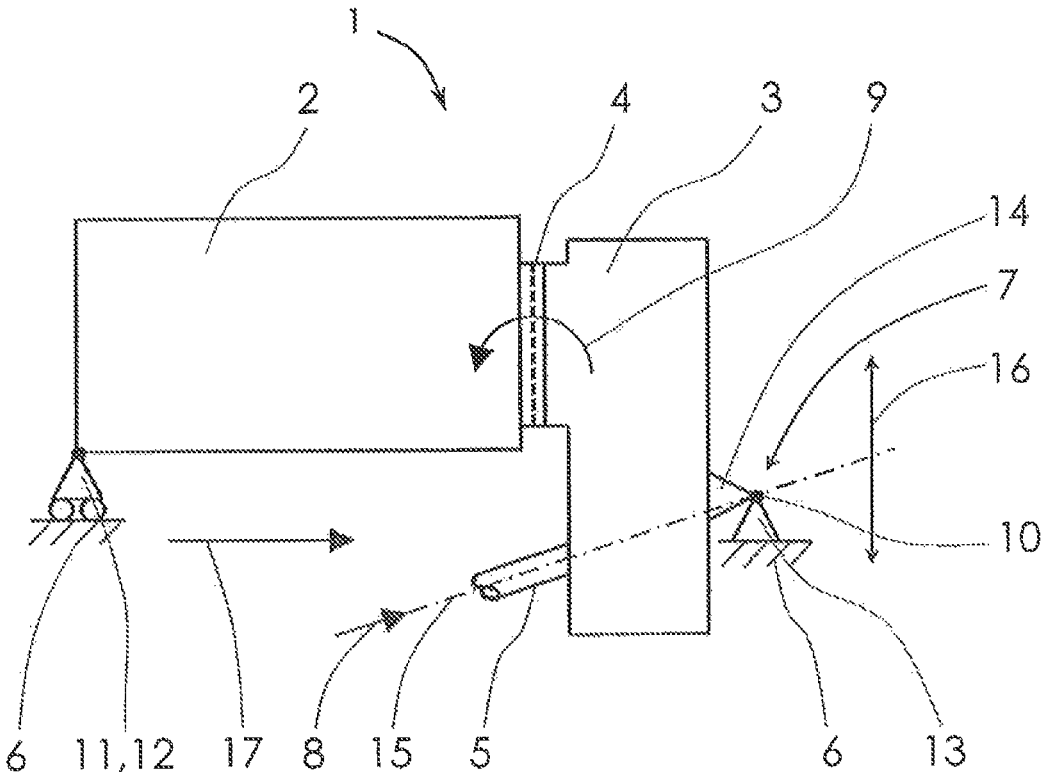
FIG. 1: A schematic representation of the structure of a ship drive according to the invention, viewed from the side.
Figure 2:
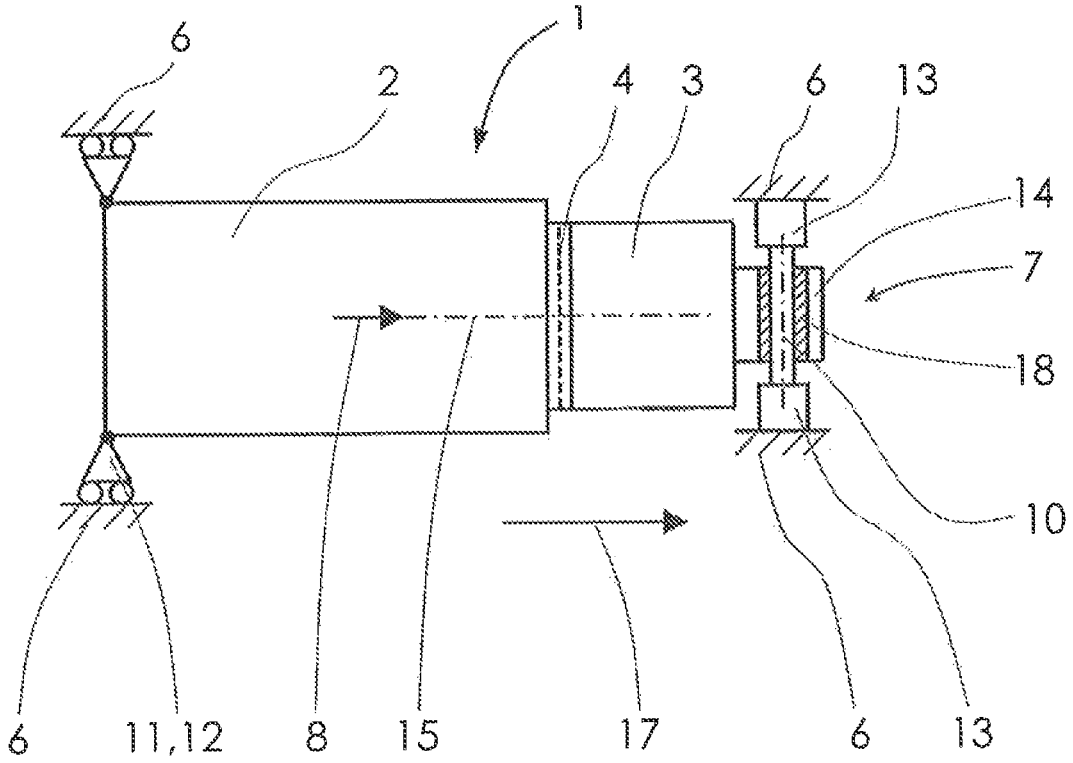
FIG. 2: A schematic representation of the structure of a ship drive according to the invention, viewed from above.

FIGS. 1 and 2 show different views of the same embodiment of the invention. Accordingly, the same elements are denoted by the same indexes in the two figures.

The ship drive 1 comprises, besides its mounting arrangement, a drive machine 2, a transmission 3 and a propeller shaft 5, which is driven by way of the transmission 3 and which is the drive output shaft of the latter. During operation the propeller shaft 5 rotates about its rotational axis 15 and drives a propeller (not shown), which in the water produces the desired propulsion. For this, the propeller rotating in the water produces a propeller thrust 8, denoted in FIG. 1 by an arrow. The propeller thrust 8 is the force that propels the ship and is transmitted for example by a thrust bearing (not shown) to the transmission 3, and from there by way of the housing of the transmission 3 and by way of the pivot bearing 7 to the hull 6 of the ship.

The drive machine 2 is for example an internal combustion engine, an electric drive or a hybrid drive. The drive machine 2 and the transmission 3 are connected to one another by a connecting flange, for example by means of screw-bolt connections.

The ship drive 1 is secured in the hull 6 of a ship by means of a mounting arrangement consisting of a first mounting point in the form of a pivot bearing 7, a second mounting point 11 and a third mounting point 12. Of the ship's hull 6, the schematic representations in the figures show only the sections to which the respective mounting points 7, 11 and 12 are attached. As a rule, these are secured in the ship's hull 6 to longitudinal support members (not shown), which are part of the hull 6 of the ship.

By virtue of the three mounting points 7, 11 and 12 all the forces and torques produced by the ship drive 1 are supported relative to the ship's hull 6. The first mounting point 7 is in the form of a pivot bearing 7 and enables the compensation of distortions within the ship drive 1. In particular, the pivot bearing 7 allows rotational distortions about the pivot axis 10, which extends horizontally and perpendicularly to the travel direction 17 of the ship. For representational reasons, in FIG. 2 the second and third mounting points 11 and 12 are shown rotated through 90 degrees in the plane of the drawing. However, they are designed such that they absorb substantially vertically-directed forces such as the weight of the drive machine 2 and the transmission 3. The second and third mounting points 11 and 12 assist the described distortion compensation ability, since they permit displacement in, and opposite to the travel direction 17. A travel direction arrow 17 shows the forward travel direction of the ship.

The pivot bearing 7 comprises a mounting portion 14 connected securely to the transmission 3, which can even be formed integrally with a housing of the transmission 3. The pivot bearing 7 is connected to the ship's hull 6 by means of a holding fixture 13, which is represented as having two parts in FIG. 2 but can also be made integrally, in one part. In the force flow between the mounting portion 14 and the ship's hull 6 is arranged a vibration-absorbing element 18. This vibration-absorbing element 18 has a favorable effect on noise emission, i.e. the noise level is reduced. Furthermore, troublesome vibrations are reduced close to their source, in this case the drive machine 2. Both these effects improve passenger comfort and reduce the loading of other components of the ship.

By virtue of the mounting arrangement described, the weight of the drive machine 2 and the transmission 3 produce a bending moment 9 at the connecting flange 4. This bending moment stresses the elements of the connecting flange 4 and can be reinforced by oscillations during the movement of the ship. In addition to the bending moment produced by the weight of the drive machine 2 and transmission 3, as a result of the propeller thrust 8 the propeller shaft 5 can produce an additional torque in the transmission 3, which influences the size of the bending moment 9 in the area of the connecting flange. However, the size of this additional torque depends on the position of the rotational axis 15 of the propeller shaft 5 relative to the pivot axis 10 of the pivot bearing 7. If the pivot axis 10 is displaced relative to the rotational axis 15 in the vertical direction along the direction arrow 16 indicated, the size of the torque changes.

If, as in the embodiment of the present invention shown in FIG. 1, the rotational axis 15 of the propeller shaft 5 passes exactly through the pivot axis 10, then no additional torque is produced by the propeller thrust 8 and the bending moment 9 at the connection flange 4 remains uninfluenced by the propeller thrust 8. In that case the propeller thrust force is transmitted directly from the propeller shaft 5 by way of a thrust bearing (not shown) into the transmission 3, and from there via the housing of the transmission 3 and via the pivot bearing 7 to the hull 6 of the ship.

According to another embodiment of the invention the propeller shaft 5 can be displaced vertically upward along the direction arrow 16, so that the rotational axis 15 passes above the pivot axis 10 of the pivot bearing 7. In this arrangement the propeller thrust 8 produces torque in the ship drive 1 which is directed in opposition to the bending moment 9 at the connecting flange 4 and which therefore at least partially compensates for the bending moment 9. In this way the maximum loading on the connecting flange 4 can be restricted in certain operating phases.

INDEXES

1 Ship drive
2 Drive machine
3 Transmission
4 Connecting flange
5 Propeller shaft
6 Ship's hull
7 Pivot bearing
8 Propeller thrust
9 Bending moment
10 Pivot axis
11 Second mounting point
12 Third mounting point
13 Holding fixture
14 Bearing portion
15 Rotational axis
16 Direction arrow
17 Travel direction arrow
18 Vibration-absorbing element

The invention claimed is:

1. A ship drive (1) comprising:
a drive machine (2),
a transmission (3),
a propeller shaft (5) driven by the transmission (3), and
a mounting arrangement by which the ship drive (1) is secured to a hull (6) of a ship,
the drive machine (2) and the transmission (3) being connected to one another by a connecting flange (4) and being arranged inside the hull (6) of the ship,
a first mounting point, designed as a pivot bearing (7) relative to a rotational axis (15) of the propeller shaft (5), being arranged on a side of the transmission opposite from the drive machine in such a manner that a bending moment (9), produced by propeller thrust (8) and by a weight of the drive machine (2) and the transmission (3), being optimized at the connecting flange (4), and
the rotational axis (15) of the propeller shaft (5) passes vertically above a pivot axis (10) of the pivot bearing (7).

2. The ship drive according to claim 1, wherein the rotational axis (15) of the propeller shaft is located within a 500 mm zone about the pivot axis (10) of the pivot bearing (7), and a distance between the rotational axis (15) and the pivot axis (10) is less than 500 mm.

3. The ship drive according to claim 1, wherein the rotational axis (15) of the propeller shaft is located within a 100 mm zone about the pivot axis (10) of the pivot bearing (7), and a distance between the rotational axis (15) and the pivot axis (10) is less than 100 mm.

4. The ship drive according to claim 1, wherein the pivot axis (10) of the pivot bearing (7) extends substantially horizontally and is located on a leading side of the transmission with respect to a forward travel direction of the ship.

5. The ship drive according to claim 1, wherein the pivot bearing (7) is firmly secured to longitudinal support members of the hull (6) of the ship by a holding fixture (13).

6. The ship drive according to claim 1, wherein at least a bearing portion (14) of the first mounting point is made integrally with a housing of the transmission.

7. The ship drive according to claim 1, wherein the first mounting point comprises at least one vibration-absorbing element (18).

8. The ship drive according to claim 1, wherein the mounting arrangement comprises exactly three mounting points, and a second (11) and a third mounting point (12) are arranged on the drive machine (2).

9. The ship drive according to claim 8, wherein the second and the third mounting points comprise vibration-absorbing elements.

10. A ship being powered by a ship drive (1), and the ship drive (1) comprising:
a drive machine (2),
a transmission (3),
a propeller shaft (5) driven by the transmission (3), and
a mounting arrangement by which the ship drive (1) is secured to a hull (6) of a ship,
the drive machine (2) and the transmission (3) being connected to one another by a connecting flange (4) and being arranged inside the hull (6) of the ship,
a first mounting point, designed as a pivot bearing (7) relative to a rotational axis (15) of the propeller shaft (5), being arranged on a side of the transmission opposite from the transmission shaft in such a manner that a bending moment (9), produced by propeller thrust (8) and by a weight of the drive machine (2) and the transmission (3), being optimized at the connecting flange (4), and
the rotational axis (15) of the propeller shaft (5) passes vertically above a pivot axis (10) of the pivot bearing (7).

11. A ship drive comprising:
a drive machine,
a transmission,
a propeller shaft extending, with respect to a forward travel direction of a ship, from a rear side of the transmission and being rotationally driven by the transmission, and
a mounting arrangement for securing the ship drive to a hull of the ship,
the drive machine and the transmission being arranged inside the hull of the ship and being connected to one another by a connecting flange,
the mounting arrangement comprising a pivot bearing which defines a pivot axis extending normal to a rotational axis of the propeller shaft and is located on a leading side of the transmission with respect to the forward travel direction of the ship, and
the pivot bearing mounting the transmission to the hull such that the rotational axis of the propeller shaft passes vertically above the pivot axis of the pivot bearing such that a bending moment, produced by propeller thrust and weight of the drive machine and the transmission, is optimized at the connecting flange.

* * * * *